US005891598A

United States Patent [19]

Miyabe et al.

[11] Patent Number: 5,891,598

[45] Date of Patent: Apr. 6, 1999

[54] PRINTING PLATES USING INDIRECT ELECTROPHOTOGRAPHIC PROCESS

[75] Inventors: Masamitsu Miyabe, Oume; Toshihiro Koike, Urawa; Junichi Nouda, Tokyo; Yoshihisa Kimura, Urawa, all of Japan

[73] Assignee: Kimoto Co., LTD., Japan

[21] Appl. No.: 848,272

[22] Filed: Apr. 29, 1997

Related U.S. Application Data

[63] Continuation of Ser. No. 498,720, Jul. 5, 1995, abandoned.

[30] Foreign Application Priority Data

| | | | |
|---|---|---|---|
| Jul. 6, 1994 | [JP] | Japan | 6-155067 |
| Dec. 28, 1994 | [JP] | Japan | 6-329050 |
| Dec. 28, 1994 | [JP] | Japan | 6-329051 |
| Jun. 27, 1995 | [JP] | Japan | 7-183475 |

[51] Int. Cl.[6] ..... G03G 13/28

[52] U.S. Cl. ..... 430/49

[58] Field of Search ..... 430/49

[56] References Cited

U.S. PATENT DOCUMENTS 5,212,030 5/1993 Figov ..... 430/49

*Primary Examiner*—Mark Chapman
*Attorney, Agent, or Firm*—Lorusso & Loud

[57] ABSTRACT

The present invention is directed to a printing plate using an indirect electrophotographic process. The printing plate comprising an image receiving layer provided on a surface of plastic film wherein the image receiving layer comprises two types of extender pigments having different average particle size range to impart unevenness to the surface of the image receiving layer. The printing plate is suitable for use as a printing plate for lithography.

12 Claims, 2 Drawing Sheets

PRINTING PLATES USING INDIRECT ELECTROPHOTOGRAPHIC PROCESS

This application is a continuation, of application Ser. No. 08/498,720 filed Jul. 5, 1995, now abandoned.

BACKGROUND OF THE INVENTION

1. Field of the Invention

The present invention relates to printing plates using the indirect electrophotographic process. In particular, it relates to printing plates using the indirect electrophotographic process, which can reduce toner scattering, i.e., unwanted background images formed by toner particles, and prevent blur around toner images without reducing toner image density upon image formation.

2. Related Art

With recent developments of office work equipments and office automation, printing techniques utilizing printing plates using the indirect electrophotographic process of which plate making is easily accomplished by electrophotography, laser beam printers or the like are rapidly spreading in light printing field.

In particular, techniques where computer data or the like are directly outputted to printing plate materials by means of electrostatic printing machines including laser beam printers do not require block copy making unlike electrophotography and therefore they are excellent in plate making speed and their cost. For this reason, demand for such techniques are increasing late years.

Such electrostatic printing machines use dry toners for transferring and fixing images on surfaces of printing plates and, upon printing, surface portions of the plates deposited with toner receive lipophilic printing ink, i.e., they are made into image areas. Printing plates carrying image areas so formed are then subjected to a desensitization treatment with an etching solution and used as printing masters in lithography.

As such printing plates using the indirect electrophotographic process as described above, various materials such as those having an image receiving layer containing zinc oxide and formed on a water-resistant support have been proposed.

However, conventional printing plates using the indirect electrophotographic process suffer scattering of toner in non-image areas, i.e., unwanted background images formed by toner particles, upon toner image formation during plate making. Even if such unwanted background images formed by toner particles are not recognizable in images printed by laser beam printers, small amount of toner particles may carry ink when the plates are used for printing and may cause serious contamination to such an extent that commercial value of resulting printed matter is deteriorated.

Printing plates utilizing strongly hydrophilic resins such as carboxymethyl cellulose as a binder of image receiving layer have been known as materials which may solve the problem of unwanted background images formed by toner particles. However, since surface hardness of the image receiving layers utilizing such a binder is not so good and therefore printing durability is reduced.

To improve printing durability, printing plates utilizing polyvalent metal salts as a hardening agent together with hydrophilic binders have also been proposed. However, these printing plates have a drawback that they show reduced efficiency of toner transfer upon printing by electrostatic transfer techniques, since surface resistivity of their image receiving layers is lowered.

To solve the problem of unwanted background images formed by toner particles, also proposed is the method wherein printing plates are subjected to a desensitization treatment with an etching solution after toner image formation on the plates and non-image areas of the plates are treated with a special emulsion to eliminate unwanted background images formed by toner particles (Japanese Patent Application Laid-open [KOKAI] No. 4-320844). However, this method is not so preferred because it requires further specific treatments after the etching treatment, which may lower operability and increase the process cost.

In addition, toner images formed by output of laser beam printers often exhibit blur around the images and resulting printing plates obtained from such images cannot provide clear toner images.

Apart from these problems, paper, plastice films or the like have been used for the conventional substrate of the printing plates using the indirect electrophotographic process.

However, paper, despite of its low cost, has problematic durability. Plastic films has durability but deformes at a relatively low temperature. For example, since the most common polyester film deforms at about 120° to 150° C., the plastic films begins to soften and deform when it is heated over that temperature. Accordingly, in case that a printing plate material having a plastic film as its substrate is formed to a printing plate by PPC copier, the plastic film is deformed by fusing heat and thereby the printing plate is out-put with severely waving. This phenomenon is particular when using the machine whose fusing temperature is high or that whose fusing time is long, such as laser beam printer (referred as LBP hereinafter) and it causes a jamming of the printing plate on the pass inside the machine.

SUMMARY OF THE INVENTION

The present invention has been completed to solve the above-described problems observed in conventional materials and its object is to provide printing plates using the indirect electrophotographic process which are capable of, without any additional treatments after the etching treatment, markedly reducing unwanted background images formed by toner particles and providing clear printed images while satisfactorily maintaining toner transfer efficiency in image areas. Further, it is also an object of the present invention to provide printing plates using the indirect electrophotographic process which are capable of markedly reducing blur around toner images and providing clear printed images.

It is another object of the present invention to provide printing plates using the indirect electrophotographic process which can drastically reduce the waving of the whole of the printing plate by heat.

As a result of our researches to achieve the objects described above, it was found that image receiving layers containing two kinds of pigments having different particle size ranges, which may control surface conditions of the image receiving layers, can solve the problem of unwanted background images formed by toner particles. It was also found that blur around toner images is caused by high and, in addition, uneven surface resistivity of printing plates using the indirect electrophotographic process. Based on these findings, the present invention has been completed.

Accordingly, the first embodiment of the printing plate using the indirect electrophotographic process of the present invention comprises an image receiving layer provided on a surface of a plastic film and comprising two kinds of extender pigments having different particle size ranges, i.e., distinguished from each other by their particle size ranges, to impart unevenness to the surface. The printing plates using the indirect electrophotographic process of the present invention may comprise an image receiving layer provided on a surface of a plastic film and comprising a polymer binder, zinc oxide and two kinds of extender pigments having different particle size ranges. Preferably, one kind of the extender pigments has a particle size range of from 3 to 5 μm, and the other has a particle size range of from 7 to 10 μm. The extender pigments are preferably composed of silica.

The second embodiment of the printing plate using the indirect electrophotographic process of the present invention comprises an electro-conductive layer and an image receiving layer laminated on a surface of plastic film in this order. Preferably, the image receiving layer comprises a polymer binder, zinc oxide and two kinds of extender pigments having different particle size ranges and the electro-conductive layer and the image receiving layer are laminated on a surface of plastic film in this order. Further, the electro-conductive layer preferably contains needle-like crystals of metal salts and the needle-like crystals are preferably dispersed in an ultrahigh molecular weight polymer having a molecular weight of not less than 300,000.

Such an electro-conductive layer provides a desired surface resistivity of the printing plates using indirect electrophotographic process and thereby blur around toner images generated upon image formation by laser beam printers is prevented and clear images can be obtained by resulting printing plates.

The electro-conductive layer preferably comprises needle-like crystals of metal salts, because such needle-like crystals can impart higher electro-conductivity to the coating with a smaller amount thereof compared with other shapes such as particles, scales and cylindrical fibers. The needle-like crystals can impart uniform and stable electro-conductivity and a desired resistance of the coating may be easily obtained. They also show heat resistance since they are composed of metal salts and hence they can provide excellent and stable electro-conductivity even under high temperature conditions. Because desired electro-conductivity can be obtained with a small amount of the conductive agent, the amount of the binder in the coating can be increased to improve the coating strength of the electro-conductive layer, and hence printing durability can be improved.

The needle-like crystals is preferably dispersed in an ultrahigh molecular weight polymer having a molecular weight of not less than 300,000, preferably not less than 400,000. Due to poor coating properties of the electro-conductive layers, they may be shaved by a coating head when applying image receiving layer solution thereon. This may lead uneven thickness of the electro-conductive layer and hence uneven surface resistivity. However, by dispersing the needle-like crystals in an ultrahigh molecular weight polymer, the coating properties of the electro-conductive layer are improved and the layer is prevented from being shaved by a coating head and thereby uneven surface resistivity is prevented.

The third embodiment of the printing plate using indirect electrophotographic process which comprises a plastic film, cured resin layer having a hardness equal to or harder than a pencil hardness (JIS-K5400) of H provided on the either side of the plastic film and an image-receiving layer provided on the cured resin layer. The cured resin layer may be formed by at least photopolymerizable prepolymer, photopolymerizable monomers and photopolymerization initiators and preferably further contains matting agent.

Figure 1:
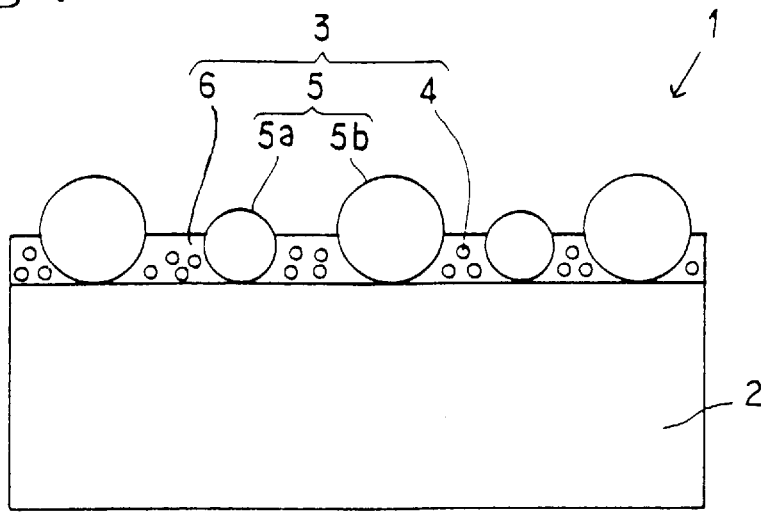
FIG. 1 is a schematic cross-sectional view of an embodiment of the present invention.

The drawings show the printing plate using the indirect electrophotographic process of the present invention 1, 11, plastic film 2, image receiving layer 3, pigment for making non-image areas hydrophilic 4, pigment for imparting unevenness to the surface 5, small size pigment 5*a*, large size pigment 5*b*, polymer binder 6, electro-conductive layer 7 and needle-like crystals 7*a*.

DETAILED EXPLANATION OF THE INVENTION

The printing plates using the indirect electrophotographic process of the present invention will be explained in detail hereinafter.

As shown in FIG. 1, the printing plate using the indirect electrophotographic process of the present invention 1 comprises an image receiving layer 3 provided on a plastic film 2.

The plastic film 2 has strength sufficient to serve as a support to impart printing durability. It may be a film composed of, for example, homopolymers such as polyethersulphone, polyester, poly(meth)acyrylate, polycarbonate, polyamide and poly(vinyl chloride), or copolymers of the monomers contained in the previously mentioned homopolymers and other copolymerizable monomers. The thickness may preferably be of from 50 to 188 μm, particularly of from 75 to 125 μm from the viewpoints of heat resistance and image density.

Preferably, the plastic film is a foamed film. Foamed films have numerous voids and therefore they are excellent in bendability.

To prevent curling, the plastic film may be backed with an anti-curling layer or a curling layer as described hereinafter.

The image receiving layer 3 provided on the plastic film 2 fixes lipophilic toner of printers and areas where the toner is not deposited are desensitized with etching solution so that they repel lipophilic printing ink.

The image receiving layer comprises pigment 4 for making non-image areas hydrophilic and pigments 5 for imparting unevenness to the surface. The pigments 5 for imparting unevenness to the surface are constituted by two kinds of extender pigments 5 having different particle size ranges dispersed in a polymer binder 6. Since the image receiving layer comprises specific amounts of the extender pigment having a smaller particle size range 5*a* (referred to as "small size pigment" hereinafter) and the extender pigment having a larger particle size range 5*b* (referred to as "large size pigmen" hereinafter), the surface configuration of the image receiving layer can be controlled to have a specific configuration. The specific surface configuration of the image receiving layer of the printing plate using the indirect electrophotographic process may improve unwanted background images formed by toner particles, toner transfer efficiency and printing durability.

The small size pigment contained in the image receiving layer has a particle size within a range of 3 to 5 μm, and the large size pigment has a particle size within a range of 7 to 10 μm. The particle size ranges of the pigments herein used mean that peak sizes in particle size distribution of the pigments fall within the specified ranges. The small size pigment and the large size pigments are used in a weight ratio of 3:7 to 7:3. The small size pigment is used in an amount of more than 30% in order to improve toner transfer efficiency upon outputting and prevent decrease of image density. The small size pigment is used in an amount of not more than 70% in order to prevent unwanted background images formed by toner particles. Further, the small size pigment preferably has an average size of 3 to 5 μm, because the pigments having a size of not less than 3 μm can prevent unwanted background images formed by toner particles and the pigments having a size of not more than 5 μm can improve toner transfer efficiency upon outputting and prevent decrease of image density. The large size pigment preferably has an average size of 7 to 10 μm, because the pigment having a size of not less than 7 μm can prevent unwanted background images formed by toner particles and the pigment having a size of not more than 10 μm can prevent objectionable appearances of images and thus prevent dot-like contamination of printed matter.

As such extender pigments, silica, clay, barium sulfate, alumina and the like may be used alone or in any combination thereof. These extender pigments may be the same as pigments 4 for making non-image areas hydrophilic described above. The small size pigment and the large size pigment are preferably composed of the same kind of pigment. Silica is particularly preferred, since it can impart desirable hydrophilicity to the image receiving layer.

The pigment for making non-image areas hydrophilic is added to desensitize the image receiving layer. The pigment 4 can be made hydrophilic with an etching solution and may be composed of, for example, zinc oxide, titanium oxide, clay, alumina silicate and the like. When a conventional etching solution mainly composed of phosphoric acid is used, zinc oxide is particularly preferred.

The pigment for making non-image areas hydrophilic (referred as the first pigment hereinafter), e. g. zinc oxide is preferably used in an amount of 10 to 30 parts by weight, particularly 15 to 25 parts by weight, with 1 part by weight of the pigments for imparting unevenness to the surface (referred as the second imparting pigment hereinafter). The first pigment in an amount of not less than 10 parts by weight can prevent unwanted background images formed by toner particles and hence maintain printing properties, and its amount of not more than 30 parts by weight can prevent objectionable appearances of images.

As the polymer binder, which is used as a binder for the first and the second pigments to form the image receiving layer, used are materials which are capable of binding the first pigments and the second pigments, do not inhibit, but aid desensitization of the first pigments, and have flexibility as a dried coating. Examples of polymer binders having such properties are water-soluble resins such as polyvinyl alcohol, carboxymethyl cellulose, hydroxyethyl cellulose, casein, gelatin and water-soluble polyurethane, emulsion resins such as polymers and copolymers of vinyl acetate, vinyl chloride, acrylate esters, styrene, butadiene, ethylene and the like. These resins may be used alone or any combination thereof. When a water-soluble resin is used alone, it is preferably used with a suitable amount of water-proofing agent to improve printing durability.

The image receiving layer preferably contains the binder in an amount of not more than 15%, particularly, not more than 10% based on the total weight of the image receiving layer. The binder of not more than 15% may contribute to reduce the production cost, improve application properties and increase line speed. In addition, it makes possible to accomplish sufficient desensitization of non-image areas and therefore to reduce contamination upon printing.

Figure 2:
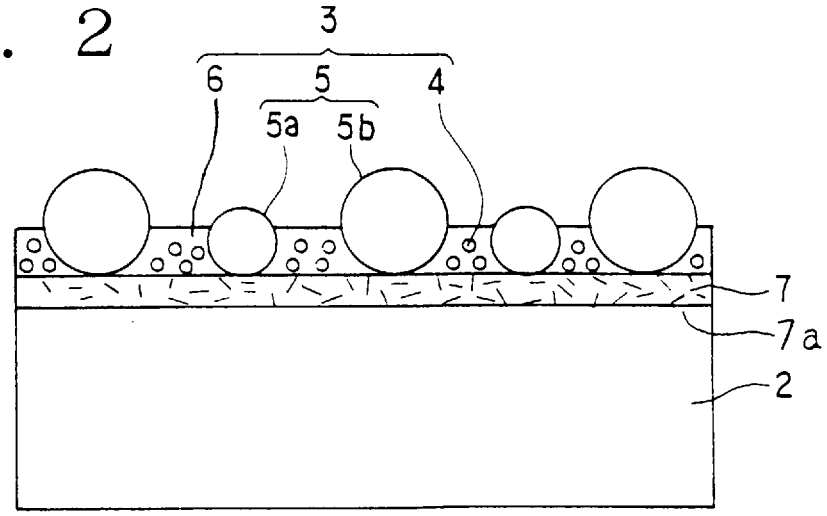
FIG. 2 is a schematic cross-sectional view of another embodiment of the present invention.
Figure 3:
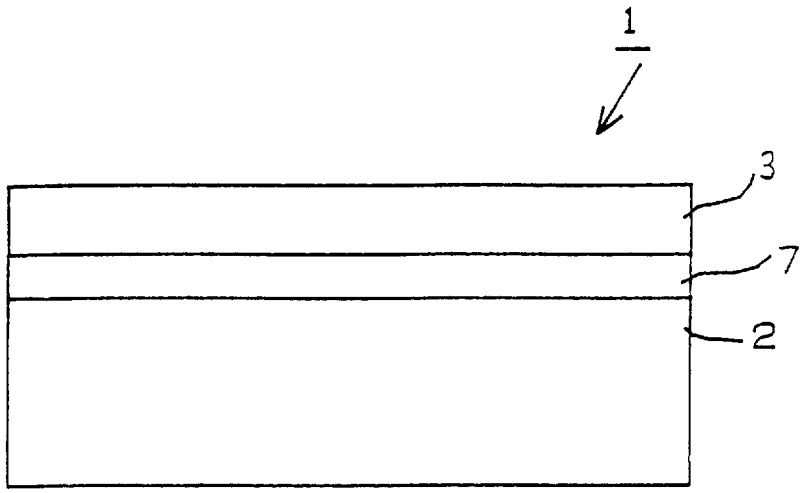
FIG. 3 is a schematic cross-sectional view of yet another embodiment of the present invention.

The printing plates using the indirect electrophotographic process according to the second embodiment of the present invention will be explained hereinafter. The printing plate using the indirect electrophotographic process of this type 11 comprises, as shown in FIGS. 2 and 3, an electro-conductive layer 7 and an image receiving layer 3 provided on a plastic film 2 in this order.

As the plastic film 2, those mentioned for the printing plates using the indirect electrophotographic process of the first embodiment can be used.

The electro-conductive layer 7 is provided in order to prevent blur around toner images observed upon output of laser beam printers and to obtain clear printed images. The electro-conductive layer preferably have a surface resistance of $10^{13}$ to $10^{15}$ Ω/□ and, when the image receiving layer is laminated on the electro-conductive layer, it shows a surface resistivity of $10^{9}$ to $10^{10}$ Ω/□. Surface resistivity of these ranges can prevent blur.

When surface resistivity is not constant, even though surface resistances of the electro-conductive layer and the image receiving layer are within the ranges identified above, or when surface resistivity of the electro-conductive layer is not more than $10^{12}$ Ω/□ and therefore surface resistivity of the image receiving layer laminated thereon is not more than $10^{8}$ Ω/□, defective image transfer may be caused depending on types of printers used. Therefore, if the electro-conductive layer has a surface resistivity of $10^{13}$ to $10^{15}$ Ω/□ and the image receiving layer has a constant surface resistivity within the range of $10^{9}$ to $10^{10}$ Ω/□ when it is laminated on the electro-conductive layer, blur and defective image transfer would be prevented regardless of the types of printers.

Conductive agents of ion conductive type such as quaternary ammonium salts may be used as conductive agents contained in the electro-conductive layer with a surface resistivity within the range defined above. However, image quality is likely to be affected by ambient conditions when they are used. Therefore, conductive agents of electron conductive type, in particular, needle-like crystals of metal salts are preferred. The electro-conductive layer is formed by dispersing these conductive agents in hydrophobic organic polymer materials, in particular, a polymer binder consisiting of cross-linkable polymer materials capable of being made insoluble or hardly soluble in organic solvents after curing. Alternatively, the electro-conductive layer may be formed by dispersing the conductive agents in ultrahigh molecular weight polymers.

Examples of the conductive agent of electron conductive type include, conductive mica, zinc oxide, tin oxide, indium oxide, titanium oxide, vanadium oxide, impalpable metal powders and the like.

Needle-like crystals of metal salts may also be preferably used. Particularly preferred are very fine needle-like crystals 7*a* in a shape of square pole fiber having, for example, a diameter of 0.4 to 0.7 μm and a length of 10 to 20 μm. Since such needle-like crystals can impart higher electro-conductivity to the coating with a smaller amount compared with other shapes such as particles, scales and cylindrical fibers, they can impart uniform and stable electro-conductivity. Further, desired resistance of the coating may be easily obtained with them. They also show heat resistance since they are composed of metal salts and hence they can impart excellent and stable electro-conductivity even under high temperature conditions. Because desired electro-conductivity can be obtained with a small amount of the conductive agent, the amount of the binder in the coating can be increased to improve the coating strength of the electro-conductive layer and hence improve anti-scratch property. Potassium titanate is a preferred metal salt. Potassium titanate deposited with conductive carbon by CVD technique, potassium titanate coated with conductive tin oxide doped with antimony oxide by wet adsorption technique, or coated with metal silver and the like may be used. In particular, when needle-like crystals of potassium titanate adsorbing conductive tin oxide doped with antimony oxide are used together with titanium oxide, brightness of the electro-conductive layer may be improved without affecting on surface resistivity of the electro-conductive layer, and therefore it is possible to obtain desired color by using them together with various pigments.

The conductive agent of needle-like crystals is added to the binder in an amount of 2 to 5 parts by weight, preferably 3 to 4 parts by weight to impart the surface resistance defined above to the electro-conductive layer. Not less than 2 parts by weight of the crystals can prevent blur and not more than 5 parts by weight of the crystals can provide surface resistivity of $10^{13}$ to $10^{15}$ Ω/□ for the electro-conductive layer and of $10^{9}$ to $10^{10}$ Ω/□ for the image receiving layer when it is laminated on the electro-conductive layer, and thereby defective image transfer can be prevented.

As the polymer binder materials in which the conductive agent is dispersed, conventionally used hydrophobic organic polymer materials such as polymers and copolymers of vinyl acetate, vinyl chloride, styrene, butadiene, acrylate esters, methacrylate esters, ethylene, acrylonitrile and the like, silicon resins, polyester resins, polyurethane resins, alkyd resins, epoxy resins and the like can be used. However, cross-linkable polymer materials are particularly preferred, since they are not affected by ambient conditions, excellent in solvent resistance and not changed with time.

Examples of the cross-linkable polymer materials are, for example, urethane resins of cross-linkable type, acryl resins, phenol resins and melamine resins, amino resins such as urea resins, alkyd resins, epoxy resins, butyral resins, organosilicon compounds, petroleum resins, unsaturated polyester resins and the like, and they can be used alone or in any combination thereof. After coating these resins, they are cross-linked and cured, if necessary, by heat treatment, UW treatment, electron beam, or adding cross-linking agents or additives. It is also possible to use one or more of these cross-linkable resins together with one or more of the conventional hydrophobic resins such as those mentioned previously.

The ultrahigh molecular weight polymers in which the conductive agents are dispersed have a molecular weight of not less than 300,000, preferably not less than 400,000, and their examples include acrylic resins (e.g., M-1002B and M-2000 available from Soken Chemical Co.,Ltd.). The ultrahigh molecular weight polymers are particularly preferred when the conductive agent of needle-like crystals is used. Electro-conductive layers composed of such binders and the conductive agent of needle-like crystals dispersed therein can, together with the large content of the binder in the coating, increase coating strength of the electro-conductive layers and improve anti-scratch property. Therefore, upon forming the image receiving layer on the electro-conductive layer, the electro-conductive layer is prevented from being shaved by a coating head for coating the image receiving layer.

The image receiving layer 3 formed on the electro-conductive layer 7 fixes lipophilic toner of printers and areas where the toner is not deposited are desensitized with an etching solution so that they repel lipophilic printing ink. To form such image receiving layers, strongly hydrophilic resins such as carboxymethyl cellulose can be used. In addition, polyvalent metal salts such as zinc oxide, titanium oxide and aluminium silicate may be dispersed in a polymer binder.

Preferred structure of the image receiving layer, as shown in FIG. 2, is the same one as that of printing plate using the indirect electrophotographic process of the first embodiment of the present invention 1.

Further, the printing plates using the indirect electrophotographic process of the present invention may comprise an anti-curling layer (not shown) or curling layer (also not shown) on one surface of the plastic film opposite to the surface provided with the image receiving layer. The anti-curling layer or the curling layer is provided to prevent printing plates discharged from laser beam printers, on which toner has been transferred, from curling to the toner deposited side, or to curl them to the side opposite to the toner deposited side. The anti-curling layer may be composed of nitrocellulose and the like and maintain the printing plates flat. The curling layer may be composed of a resin for hard coating such as UV-curing resins and curl the printing plates to the side opposite to the toner deposited side. The anti-curling layer and the curling layer can improve the operability when completed machine plates are mounted on plate cylinders for offset printing.

As described previously, the plastic film of the printing plate may have the cured resin layer. The cured resin layer is provided on either side of the plastic film to fix the plastic film and thereby prevent its deformation by heat, that is, to improve the properties of the plastic film.

To obtain the above-mentioned property, the hardness of the cured resin layer should be equal to or harder than a pencil hardness of H defined by JIS-K5400, preferably equal to or harder than 2H. When the hardness is equal to or harder than H, deformation of the plastic film by heat is suppressed.

The cured resin layer may be formed by a paint comprising thermoset resin or ionizing radiation cured resin. Particularly, the ionizing radiation cured resin is preferred in the view of working efficiency or productivity. The ionizing radiation cured resin is defined here as a curable resin by electron beam or ultra violet beam and comprises at least photopolymerizing prepolymer, photoporimerizing monomers and phtoporimerization initiators. The resin may include, if required, solvent or additives such as a sensitizer, non-reactive resins, leveling agent or the like.

The printing plates using the indirect electrophotographic process of the present invention can be prepared by providing a image receiving layer solution having a composition described above and applying it to a surface of plastic film using any conventional techniques, for example, bar coating. The printing plates using the indirect electrophotographic process of the present invention can also be prepared by providing a electro-conductive layer solution having a composition described above, applying it to a surface of plastic film using any conventional techniques, for example, bar coating, and applying thereon the image receiving layer solution using any conventional techniques, for example, bar coating.

The printing plates using the indirect electrophotographic process of the present invention comprise an image receiving layer which is provided on a plastic film and contains pigment for making non-image areas hydrophilic and two kinds of pigments for imparting unevenness to the surface. This makes it possible to form their surfaces with desired physical conditions and thereby printing durability and toner transfer efficiency of image areas can be maintained sufficiently and unwanted background images formed by toner particles in non-image are markedly reduced.

Further, the structure comprising an image receiving layer provided on a plastic film and an electro-conductive layer interposed between them can suppress blur of toner and give clear printed images.

EXAMPLES

The present invention will be further explained specifically by the following examples.

Example 1

An image receiving layer solution having the following composition was bar-coated on a polyester film having a thickness of 100 μm (CRISPER G2323, Toyobo Co.,Ltd.) and dried at 150° C. for 60 seconds to give a printing plate using the indirect electrophotographic process whose image receiving layer is a thickness of 7 μm.

| Image receiving layer solution | |
|---|---|
| Electro-conductive zinc oxide (SAZEX #2000, Sakai Chemical Industry Co., Ltd.) | 45 parts by weight |
| Acrylic resin (solid content 50%, ACRYDIC 167, Daiippon Ink & Chemicals, Inc.) | 14 parts by weight |
| Synthesized silica (average particle size 4 μm, SYLYSIA 740, Fuji Silysia Chemical Ltd.) | 1 part by weight |
| Synthesized silica (average particle size 7 μm, SYLYSIA 770, Fuji Silysia Chemical Ltd.) | 1 part by weight |
| Toluol | 45 parts by weight |

Example 2

A printing plate using the indirect electrophotographic process was prepared in a manner similar to that of Example 1 except that the two kinds of synthesized silica having average particle sizes of 4 μm and 7 μm were used in amounts of 0.6 parts by weight and 1.4 parts by weight, respectively.

Example 3

A printing plate using the indirect electrophotographic process was prepared in a manner similar to that of Example 1 except that the two kinds of synthesized silica having average particle sizes of 4 μm and 7 μm were used in amounts of 1.4 parts by weight and 0.6 parts by weight, respectively.

Example 4

A printing plate using the indirect electrophotographic process was prepared in a manner similar to that of Example 1 except that two kinds of synthesized silica having average particle sizes of 3 μm (SYLYSIA 730, Fuji Silysia Chemical Ltd.) and 10 μm (SILCRON G-602, Nissan Chemical Industries, Co.,Ltd.) were used instead of the two kinds of the synthesized silica of Example 1 having average particle sizes of 4 μm and 7 μm, respectively.

Comparative Example 1

A printing plate using the indirect electrophotographic process was prepared in a manner similar to that of Example 1 except that synthesized silica having an average particle size of 12 μm (SYLYSIA 470, Fuji Silysia Chemical Ltd.) was used in an amount of 2 parts by weight instead of the two kinds of synthesized silica of Example 1 having average particle sizes of 4 μm and 7 μm.

Comparative Example 2

A printing plate using the indirect electrophotographic process was prepared in a manner similar to that of Example 1 except that synthesized silica having an average particle size of 3 μm (SYLYSIA 730, Fuji Silysia Chemical Ltd.) was used in an amount of 2 parts by weight instead of the two kinds of synthesized silica of Example 1 having average particle sizes of 4 μm and 7 μm.

Comparative Example 3

A printing plate using the indirect electrophotographic process was prepared in a manner similar to that of Example 1 except that synthesized silica having an average particle size of 5.2 μm (SYLYSIA 450, Fuji Silysia Chemical Ltd.) was used in an amount of 2 parts by weight instead of the two kinds of synthesized silica of Example 1 having average particle sizes of 4 μm and 7 μm.

Comparative Example 4

A printing plate using the indirect electrophotographic process was prepared in a manner similar to that of Example 1 except that no synthesized silica was used.

Images were formed on the obtained printing plates using the indirect electrophotographic process by using a laser beam printer (TN7270PS1, Toshiba Corporation) and unwanted background images formed by toner particles were evaluated. By using a metallurgical microscope (PME3: Olympus Optical Co.,Ltd.), number of unwanted background images formed by toner particles per 1 $mm^2$ were counted and counted numbers of less than 5 were indicated with ○, numbers of 5 to 15 with Δ, and numbers of more than 15 with x. The results are shown in Table 1.

Further, image density was evaluated. Image density was measured by a reflection densitometer (D142-3, Gletag Co.,Ltd.) and density of not less than 2 was indicated with ○, density of 1.50 to 1.99 with Δ, and density of not more than 1.49 with x. The results are shown in Table 1.

TABLE 1

| | Average particle size | | | | | | | | |
|---|---|---|---|---|---|---|---|---|---|
| | 3 | 4 | 5.2 | 7 | 10 | 12 | A | B | C |
| Example | | | | | | | | | |
| 1 | — | 1 | — | 1 | — | — | ○ | ○ | — |
| 2 | — | 0.6 | — | 1.4 | — | — | ○ | ○ | — |
| 3 | — | 1.4 | — | 0.6 | — | — | ○ | ○ | — |
| 4 | 1 | — | — | — | 1 | — | ○ | ○ | — |
| 10 | — | — | — | — | — | — | — | — | ○ |
| 11 | — | 1 | — | 1 | — | — | ○ | ○ | ○ |
| 12 | — | 1 | — | 1 | — | — | ○ | ○ | ◎ |

TABLE 1-continued

| | Average particle size | | | | | | | | |
|---|---|---|---|---|---|---|---|---|---|
| | 3 | 4 | 5.2 | 7 | 10 | 12 | A | B | C |
| 13 | — | 1 | — | 1 | — | — | ○ | ○ | ⊙ |
| Comparative Example | | | | | | | | | |
| 1 | — | — | — | — | — | 2 | ○ | Δ | — |
| 2 | 2 | — | — | — | — | — | Δ | ○ | — |
| 3 | — | — | 2 | — | — | — | Δ | Δ | — |
| 4 | — | — | — | — | — | — | X | ○ | X |

A: Unwanted background images formed by toner particles
B: Image density
C: Blur
(unit; part by weight)

From the results of Examples and Comparative Examples described above, it was found that printing plates of which image receiving layers contain extender pigments having specific and different particle sizes in specific ratios can remarkably reduce unwanted background images formed by toner particles while maintaining image density constant.

Example 5

An electro-conductive layer solution having the following composition was bar-coated on a polyester film having a thickness of 100 μm (CRISPER G2323, Toyobo Co.,Ltd.) and dried at 150° C. for 60 seconds to form an electro-conductive layer having a thickness of 3 μm.

| Electro-conductive layer solution | |
|---|---|
| Conductive agent (W-1, Mitsubishi Metal Corporation) | 45 parts by weight |
| Acrylic resin (solid content 45%, ACRYDIC AL-201, Dainippon Ink & Chemicals, Inc.) | 14 parts by weight |
| MEK | 10 parts by weight |
| Toluol | 10 parts by weight |

Further, an image receiving layer solution having the following composition was bar-coated on the above-formed electro-conductive layer and dried at 150° C. for 60 seconds to form an image receiving layer with a thickness of 7 μm and give a printing plate using the indirect electrophotographic process.

Surface resistivity of the electro-conductive layer was $10^{13}$ to $10^{15}$ Ω/□ and surface resistivity of the image receiving layer was uniformly $10^{9}$ to $10^{10}$ Ω/□.

| Image receiving layer solution | |
|---|---|
| Electro-conductive zinc oxide (SAZEX #2000, Sakai Chemical Industry Co., Ltd.) | 45 parts by weight |
| Acrylic resin (solid content 50%, ACRYDIC 167, Daiippon Ink & Chemicals, Inc.) | 14 parts by weight |
| Toluol | 45 parts by weight |

Example 6

An electro-conductive layer was formed on a polyester film identical to that of Example 5 in a manner similar to that of Example 5 using an electro-conductive layer solution having the following composition. An image receiving layer solution having the same composition as in Example 5 was coated on the above-formed electro-conductive layer in a similar manner as in Example 5 to give a printing plate using the indirect electrophotographic process.

Surface resistivity of the electro-conductive layer was uniformly $10^{13}$ to $10^{15}$ Ω/□ and surface resistivity of the image receiving layer was uniformly $10^{9}$ to $10^{10}$ Ω/□.

| Electro-conductive layer solution | |
|---|---|
| Electro-conductive pigment (needle-like crystals, DENTALL WK200B, Otsuka Chemical Co., Ltd.) | 6 parts by weight |
| Acrylic resin (solid content 45%, ACRYDIC AL-201, Dainippon Ink & Chemicals, Inc.) | 14 parts by weight |
| MEK | 10 parts by weight |
| Toluol | 10 parts by weight |

Example 7

An electro-conductive layer solution having the following composition was bar-coated on a polyester film identical to that of Example 5 and dried at 130° C. for 60 seconds to form an electro-conductive layer having a thickness of 3 μm. An image receiving layer solution having the same composition as in Example 5 was coated on the above-formed electro-conductive layer in a similar manner as in Example 5 to give a printing plate using the indirect electrophotographic process.

Surface resistivity of the electro-conductive layer was uniformly $10^{13}$ to $10^{15}$ Ω/□ and surface resistivity of the image receiving layer was uniformly $10^{9}$ to $10^{10}$ Ω/□.

| Electro-conductive layer solution | |
|---|---|
| Electro-conductive pigment (needle-like crystals, DENTALL WK200B, Otsuka Chemical Co., Ltd.) | 6 parts by weight |
| Acrylic resin (Molecular weight = 400,000, M-1002B, Soken Chemical Co., Ltd.) | 185 parts by weight |
| MEK | 71 parts by weight |

Example 8

An electro-conductive layer was formed on a polyester film identical to that of Example 1 in a manner similar to that of Example 5 using an electro-conductive layer solution having the following composition and an image receiving layer was formed in a manner similar to that of Example 5 using the same composition as used in Example 5 to give a printing plate using the indirect electrophotographic process.

Surface resistivity of the electro-conductive layer was $10^{13}$ to $10^{15}$ Ω/□ but surface resistance of the image receiving layer was around $10^{7}$ Ω/□ and was not uniform.

| Electro-conductive layer solution | |
|---|---|
| Electro-conductive pigment (needle-like crystals, DENTALL WK200B, Otsuka Chemical Co., Ltd.) | 11.1 parts by weight |
| Acrylic resin (solid content 45%, ACRYDIC AL-201, Dainippon Ink & Chemicals, Inc.) | 14 parts by weight |

-continued

| Electro-conductive layer solution | |
|---|---|
| MEK | 10 parts by weight |
| Toluol | 10 parts by weight |

Example 9

A printing plate using the indirect electrophotographic process was prepared in a manner similar to that of Example 8 except that the electro-conductive pigment (DENTALL WK200B) of Example 8 was used in an amount of 1.85 parts by weight.

Surface resistivity of the electro-conductive layer was $10^{13}$ to $10^{15}$ Ω/□, but surface resistivity of the image receiving layer was around $10^{12}$ Ω/□.

Images were formed on the obtained printing plates using the indirect electrophotographic process by using a laser beam printer (TN7270PS1, Toshiba Corporation) and blur around images was evaluated. By using a metallurgical microscope (PME3: Olympus Optical Co.,Ltd.), number of contaminations having a size of not less than 10 μm per 1 $mm^2$ were counted and plates which produced substantially no contamination were indicated with ⊙, numbers of less than 5 with ○, numbers of 5 to 10 with Δ, and numbers of more than 11 with x. The results are shown in Table 2.

TABLE 2

| | A | B | C |
|---|---|---|---|
| Example | | | |
| 5 | ○ | good | X |
| 6 | ⊙ | good | X |
| 7 | ⊙ | excellent | X |
| 8 | Δ | not so good | Δ |
| 9 | Δ | — | Δ |
| 11 | ○ | good | ○ |
| 12 | ⊙ | good | ○ |
| 13 | ⊙ | good | ○ |
| Comparative Example | | | |
| 4 | X | — | X |

A: Blur
B: Toner transfer
C: Unwanted background images formed by toner particles As seen from the results shown in Table 2, blur around images was reduced in the printing plates using the indirect electrophotographic process of the present invention and, in particular, blur around images was remarkably reduced in those plates provided with electro-conductive layers containing the needle-like crystals. Further, it was found that uniform surface resistivity within a specific range of the image receiving layers is preferred to prevent blur around images.

Example 10

An electro-conductive layer solution identical to that of Example 5 was bar-coated on a polyester film having a thickness of 100 μm (LUMIRROR, Toray industries, inc.) and dried at 150° C. for 60 seconds to form an electro-conductive layer having a thickness of 3 μm. Further, an image receiving layer identical to that of Comparative Example 4 (Example 5) was formed thereon to give a printing plate using the indirect electrophotographic process. Surface resistivity of the electro-conductive layer was $10^{13}$ to $10^{15}$ Ω/□ and surface resistivity of the image receiving layer was $10^{9}$ to $10^{10}$ Ω/□.

Example 11

A printing plate using the indirect electrophotographic process was prepared by forming an electro-conductive layer identical to that of Example 5 between a plastic film and a image receiving layer identical to those of Example 1. Surface resistance of the electro-conductive layer was $10^{13}$ to $10^{15}$ Ω/□ and surface resistivity of the image receiving layer was $10^{9}$ to $10^{10}$ Ω/□.

Example 12

An electro-conductive layer solution identical to that of Example 6 was bar-coated on a polyester film identical to that of Example 1 and dried at 150° C. for 60 seconds to form an electro-conductive layer. An image receiving layer having a composition identical to that of Example 1 was formed thereon in a manner similar to that of Example 1 to give a printing plate using the indirect electrophotographic process.

Surface resistivity of the electro-conductive layer was uniformly $10^{13}$ to $10^{15}$ Ω/□ and surface resistivity of the image receiving layer was uniformly $10^{9}$ to $10^{10}$ Ω/□.

Example 13

An electro-conductive layer solution having a composition identical to that of Example 7 was bar-coated on a polyester film identical to that of Example 1 and dried at 150° C. for 60 seconds to form an electro-conductive layer. An image receiving layer having a composition identical to that of Example 1 was formed thereon in a manner similar to that of Example 1 to give a printing plate using the indirect electrophotographic process.

Surface resistivity of the electro-conductive layer was uniformly $10^{13}$ to $10^{15}$ Ω/□ and surface resistivity of the image receiving layer was uniformly $10^{9}$ to $10^{10}$ Ω/□.

Unwanted background images formed by toner particles, image density and blur around images of the printing plates using the indirect electrophotographic process of Examples 10 to 13 were evaluated in the same manner as described above and the results are also shown in Table 1. As seen from the results shown in Table 1, the printing plates using the indirect electrophotographic process which comprise an electro-conductive layer between the plastic film and the image receiving layer and an image receiving layer containing two kinds of extender pigments having different particle size ranges provided good results with respect to all of the evaluated items, unwanted background images formed by toner particles, image density and blur.

Example 14

A paint solution for cured resin layer having the following composition was bar-coated on both sides of polyester film having a thickness of 100 μm whose surfaces ware treated for easy adhesion. Then the coating was radiated for 1 or 2 seconds by high pressure mercury vapor lamp to form a cured resin layer having a thickness of 7.0 μm and a pencil hardness of 2H (JISK-5400).

| Paint solution for the cured resin layer | |
|---|---|
| UV cured acrylic resin (UniDic 17-806, Dainippon Ink & Chemicals, Inc.) | 13.0 parts by weight |
| Photopolimerization initiator (IrgaCure 651, Ciba Geigy Inc.) | 0.3 parts by weight |
| Silica (SYLYSIA 445, Fuji Silysia Chemical Ltd.) | 4.5 parts by weight |
| Silica (Aerosil R-202: Nippon Aerosil Co., Ltd.) | 0.8 parts by weight |
| MEK | 18.0 parts by weight |
| Toluol | 23.0 parts by weight |
| Butyl acetate | 10.0 parts by weight |

An image receiving layer solution having the following composition was bar-coated on one side of the polyester film provided with the cured resin layer and dried at 150° C. for 60 seconds to give a printing plate using the indirect electrophotographic process whose an image receiving layer is a thickness of 7 μm.

| Image receiving layer solution | |
|---|---|
| Electro-conductive zinc oxide (SAZEX #2000, Sakai Chemical Industry Co., Ltd.) | 45 parts by weight |
| Acrylic resin (solid content 50%, ACRYDIC 167, Daiippon Ink & Chemicals, Inc.) | 14 parts by weight |
| Synthesized silica (average particle size 7 μm, SYLYSIA 770, Fuji Silysia Chemical Ltd.) | 2 part by weight |
| Toluol | 45 parts by weight |

Comparative Example 5

An image receiving layer identical to that of Example 13 was formed on a polyester film having a thickness of 100 μm to give a printing plate using the indirect electrophotographic process.

The toner image was output on the printing plate materials of Example 13 and Comparative example 5 using LBP (fusing temperature 180° C., TN7270PS1: Toshiba Corporation) to obtain the printing plate. As the result, the waving was not seen in the printing plate of Example 13 as in the plate before output. On the other hand. upon output, jaming of the printing plate of Comparative example 5 occurred on the pass after a fusing portion inside the printer. When a carrier paper was applied to the front portion of the material, it was output without jaming but a significant amount of waving whose height was not less than 10 mm occurred.

It is clear from the result that waving phenomenon does not occur in the printing plate of Example 13 and thereby deterioration of flatness by heat can be effectively prevented.

As clearly demonstrated by the above descriptions, the printing plates using the indirect electrophotographic process of the present invention, which comprise two kinds of extender pigments having different particle size ranges in the image receiving layer, can reduce unwanted background images formed by toner particles without reducing toner image density and can provide printed matter in good quality with good production efficiency without any additional production steps.

Further, the electro-conductive layer provided between the plastic film and the image receiving layer can control surface resistivity of the surface of the image receiving layer and reduce blur around images upon plate making and thereby printed matter can be obtained with good quality. In addition, the conductive agent composed of needle-like crystals contained in the electro-conductive layer can provide uniform surface resistance and, in addition, improve coating properties of the electro-conductive layer, and thus blur can be prevented.

Further, the printing plate using the indirect electrophotographic process of the present invention does not cause a waving phenomenon as a whole even though it is heated over the temperature where the plastic film substrate begins to deform and thereby it maintains a good flatness. And according to the printing plate using the indirect electrophotographic process of the present invention, a printing plate for lithography which does not deform by heat can be obtained.

What is claimed is:

1. A printing plate for use in an indirect electrophotographic process comprising an image receiving layer provided on a surface of plastic film, wherein the image receiving layer comprises a first pigment for making non-image areas hydrophilic and second and third pigments, said second and third pigments being extender pigments different from said first pigment and having different average particle size ranges to impart unevenness to surface of the image receiving layer, wherein one kind of the extender pigment has a particle size of from 3 to 5 μm and the other extender pigment has a particle size of from 7 to 10 μm.

2. The printing plate of claim 1, wherein the extender pigments are composed of silica.

3. A printing plate for use in an indirect electrophotographic process comprising an image receiving layer provided on a surface of plastic film, wherein the image receiving layer comprises a polymer binder, zinc oxide and two kinds of extender pigments having different average particle size ranges, wherein one kind of the extender pigment has a particle size of from 3 to 5 μm and the other extender pigment has a particle size of from 7 to 10 μm.

4. The printing plate of claim 3, wherein the extender pigments are composed of silica.

5. A printing plate for use in an indirect electrophotographic process comprising a plastic film, an image receiving layer and an electro-conductive layer provided between the plastic film and the image receiving layer, said electro-conductive layer comprising needle-shaped crystals of a metal salt.

6. The printing plate of claim 5, wherein the image receiving layer comprises a polymer binder, zinc oxide and two kinds of extender pigments having different particle size ranges.

7. The printing plate of claim 6, wherein one kind of the extender pigment has a particle size of from 3 to 5 μm and the other extender pigment has a particle size of from 7 to 10 μm.

8. The printing plate of claim 6, wherein the extender pigments are composed of silica.

9. The printing plate of claim 5, wherein the needle-shaped crystals are dispersed in an ultrahigh molecular weight polymer having a molecular weight of not less than 300,000.

10. The printing plate of claim 9, wherein the image receiving layer comprises a polymer binder, zinc oxide and two kinds of extender pigments having different particle size ranges.

11. The printing plate of claim 10, wherein one kind of the extender pigment has a particle size of from 3 to 5 $\mu$m and the other extender pigment has a particle size of from 7 to 10 $\mu$m.

12. The printing plate of claim 10, wherein the extender pigments are composed of silica.

* * * * *

UNITED STATES PATENT AND TRADEMARK OFFICE

CERTIFICATE OF CORRECTION

PATENT NO. : 5,891,598

DATED : April 6, 1999

INVENTOR(S) : MIYABE et al

It is certified that error appears in the above-identified patent and that said Letters Patent is hereby corrected as shown below:

Col. 7, line 49, "UW" should read --UV--.

Col. 11, line 59, "Daiippon" should read --Dainippon--.

Signed and Sealed this

Twenty-fourth Day of October, 2000

*Attest:*

*Attesting Officer*

Q. TODD DICKINSON

*Director of Patents and Trademarks*